United States Patent [19]

Van Zeeland et al.

[11] Patent Number: 4,553,009

[45] Date of Patent: Nov. 12, 1985

[54] KEYBOARD SWITCH WITH PIVOTAL ACTUATOR LEVER

[75] Inventors: Anthony J. Van Zeeland, Crystal Lake; Ronald S. Denley, Woodstock, both of Ill.

[73] Assignee: Oak Industries Inc., Rancho Bernardo, Calif.

[21] Appl. No.: 553,966

[22] Filed: Nov. 21, 1983

Related U.S. Application Data

[63] Continuation-in-part of Ser. No. 414,629, Sep. 3, 1982.

[51] Int. Cl.[4] ..... H01H 5/08; B41J 5/26

[52] U.S. Cl. ..... 200/340; 200/159 B; 400/479; 400/491.3

[58] Field of Search ..... 200/159 B, 340

[56] References Cited

U.S. PATENT DOCUMENTS

| | | | |
|---|---|---|---|
| 3,656,181 | 4/1972 | Pack | 200/160 |
| 3,856,998 | 12/1974 | Sims, Jr. | 200/159 R |
| 3,982,081 | 9/1976 | Demler, Jr. | 200/159 B |
| 4,249,055 | 2/1981 | Matsuo | 200/159 A |
| 4,286,125 | 8/1981 | Schäffeler et al. | 200/153 LA |
| 4,314,112 | 2/1982 | Misson et al. | 200/159 B |
| 4,447,681 | 5/1984 | Desmarais | 200/159 B |
| 4,450,331 | 5/1984 | Fukukura | 200/335 |
| 4,479,040 | 10/1984 | Denley et al. | 200/153 V |

OTHER PUBLICATIONS

"Buckling Spring Torsional Snap Actuator"; Baumeister, et al., *IBM Tech. Disclosure Bulletin;* vol. 24, No. 11B; Apr. 1982.

*Primary Examiner*—Stephen Marcus
*Assistant Examiner*—Renee S. Kidorf
*Attorney, Agent, or Firm*—Kinzer, Plyer, Dorn & McEachran

[57] ABSTRACT

A keyboard switch which is used in combination with a membrane switch array includes a housing adapted to be positioned on the membrane switch array. There is an upright opening in the housing and a plunger is reciprocal in the housing opening. There is a spring urging said plunger outwardly in said opening and there is an actuator lever pivotally mounted on said housing and positioned for engagement by said plunger. Inward movement of said plunger through a given distance causes the application of a switch closing force by said lever on the underlying switch array. The geometry of the actuator lever-plunger interface can be arranged for linear application of the switch closing force or sudden application of said force. Sudden application of the switch closing force provides a tactile feedback.

11 Claims, 16 Drawing Figures

Fig. 1.
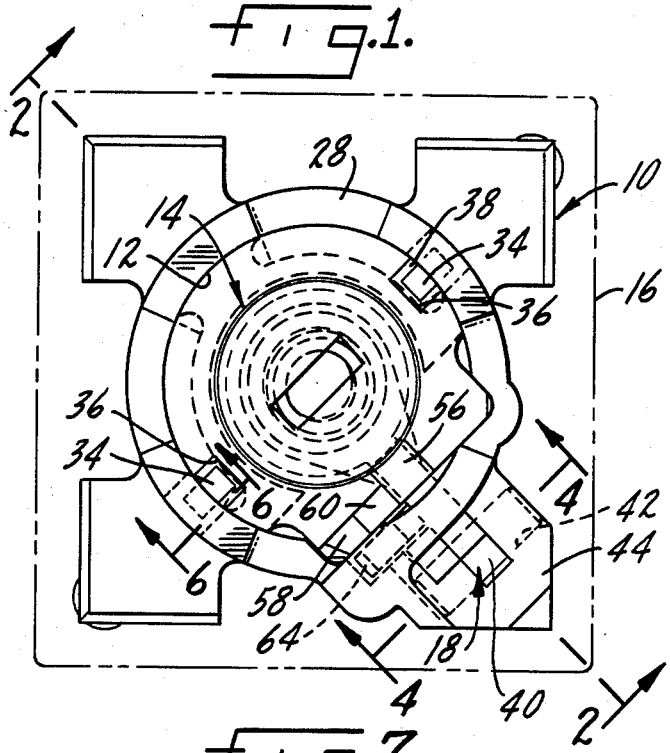
Fig. 8.
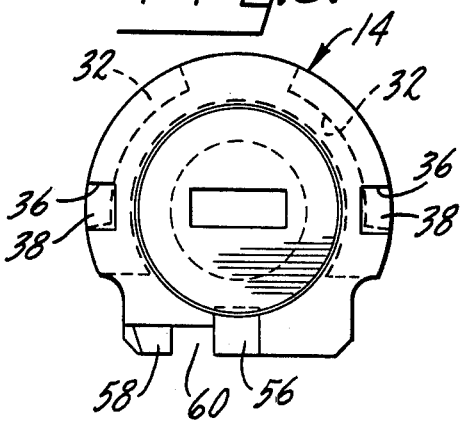
Fig. 9.
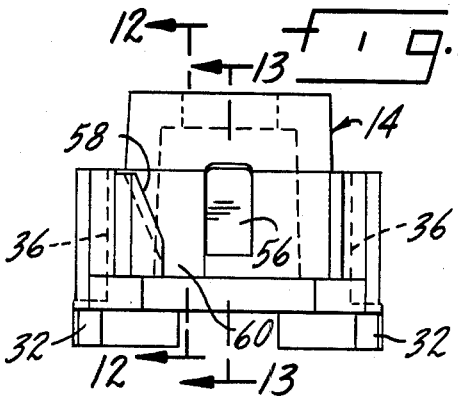
Fig. 7.
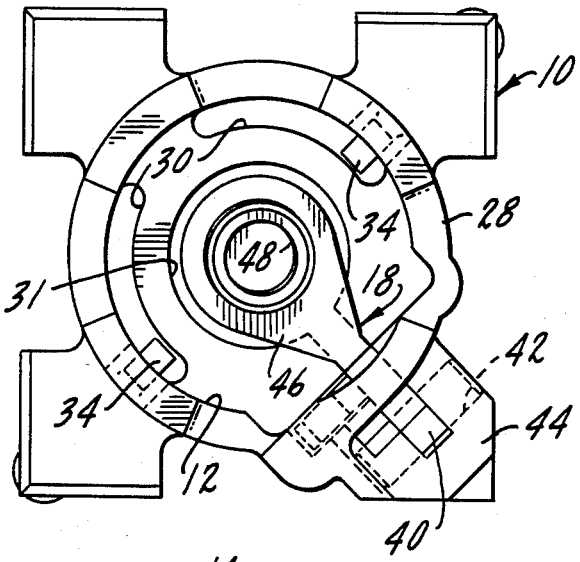
Fig. 10.
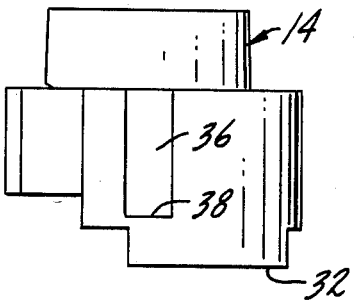
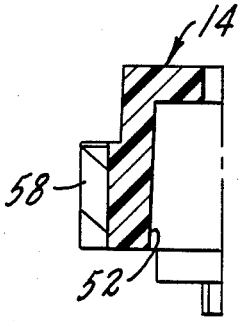
Fig. 12.
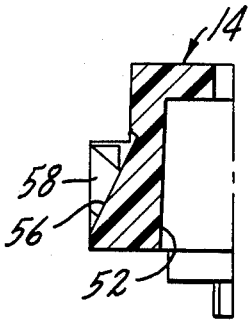
Fig. 13.
Fig. 11.
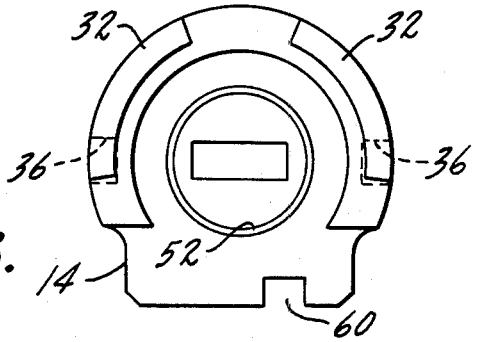

Fig. 2.
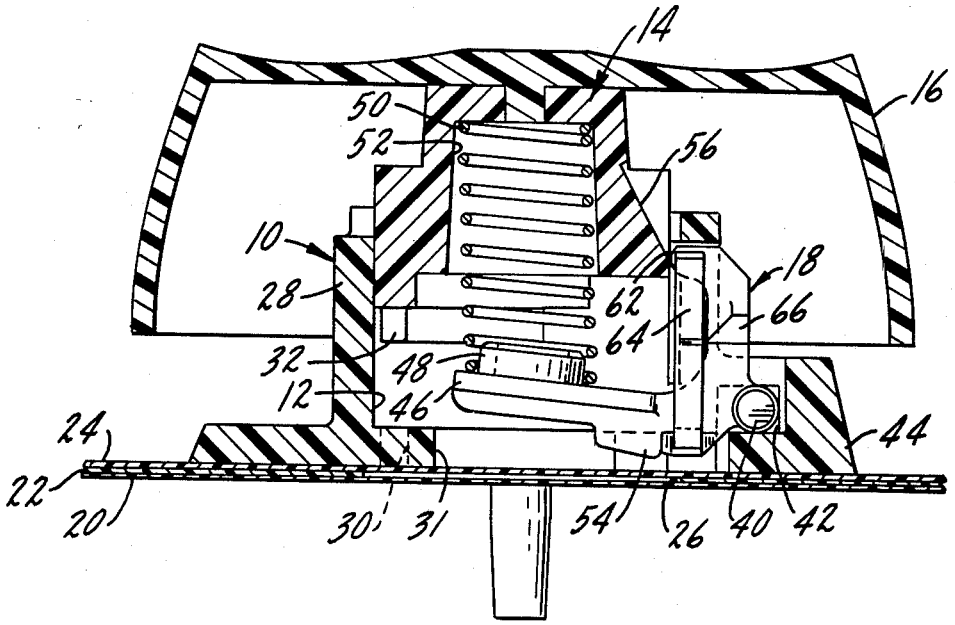
Fig. 3.
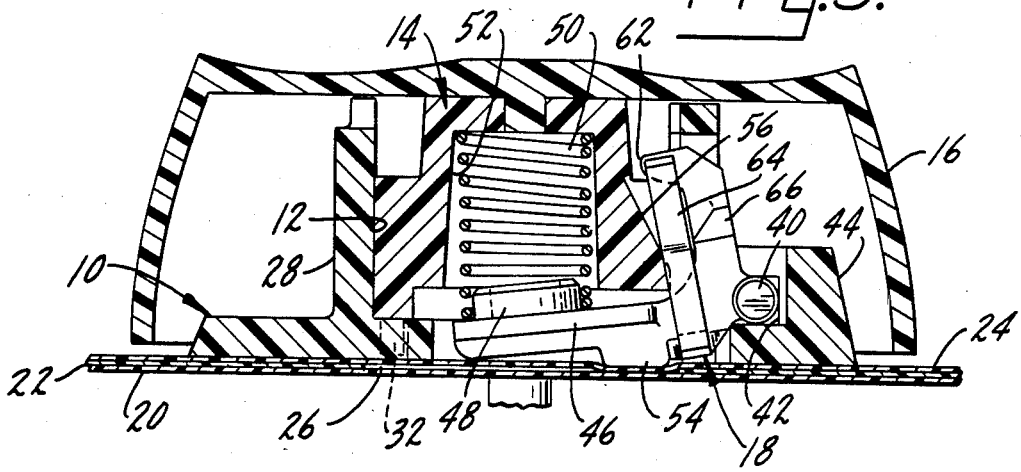
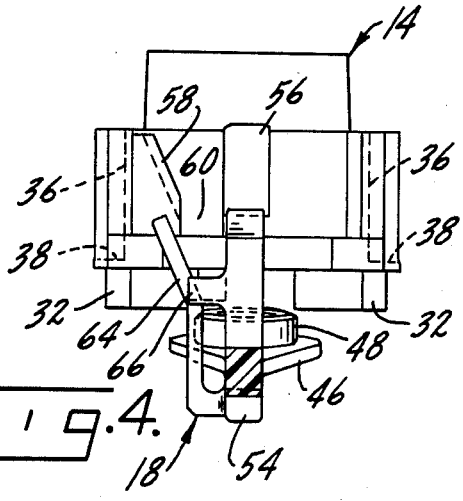
Fig. 4.
Fig. 5.
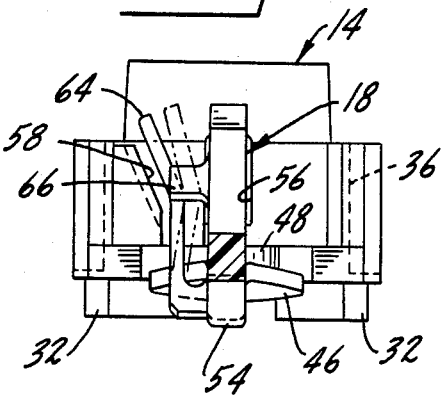
Fig. 6.
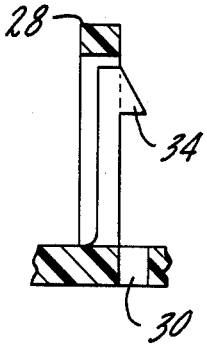

KEYBOARD SWITCH WITH PIVOTAL ACTUATOR LEVER

This is a continuation-in-part of application Ser. No. 414,629, filed Sept. 3, 1982, and assigned to the present assignee.

SUMMARY OF THE INVENTION

The present invention relates to a keyboard switch of the type conventionally used in connection with an underlying membrane switch array. A specific purpose of the invention is to provide such a keyboard switch which has a lever pivotally mounted on the key housing and cammed away from a switch closure position until such time as the plunger or key has moved inwardly a given distance.

A primary purpose of the invention is a keyboard switch of the type described in which the lever causing a switch closure is held away from a switch closing position until the operating plunger or key has moved inwardly a given distance, after which the switch closing lever will suddenly move to a switch closure position. This provides a tactile feel to indicate when a switch closure has in fact taken place.

Another purpose is a keyboard switch of the type described including sloped cam surfaces which allow the actuator lever to gradually apply a switch closing force during inward movement of the plunger.

Another purpose is a keyboard switch of the type described in which the return spring also provides the force required for switch closure movement.

Another purpose is a simply constructed, reliably operable switch of the type described.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of the switch assembly with the cap removed, but illustrated in broken lines, FIG. 2 is a section along plane 2—2 of FIG. 1 illustrating the plunger in an unoperated position, FIG. 3 is a section, similar to FIG. 2, but illustrating the plunger in a switch closure position, FIG. 4 is a view of the lever and plunger taken along the line 4—4 of FIG. 1, FIG. 5 is a view similar to FIG. 4, but showing the plunger in a depressed position, FIG. 6 is a partial side view in section taken along plane 6—6 of FIG. 1, FIG. 7 is a top plan view of the housing and the lever, FIG. 8 is a top plan view of the plunger, FIG. 9 is a side view of the plunger, FIG. 10 is a side view of the plunger as viewed from the right side of FIG. 9, FIG. 11 is a bottom view of the plunger, FIG. 12 is a section along plane 12—12 of FIG. 9, FIG. 13 is a section along plane 13—13 of FIG. 9.

DESCRIPTION OF THE PREFERRED EMBODIMENTS

Figure 14:
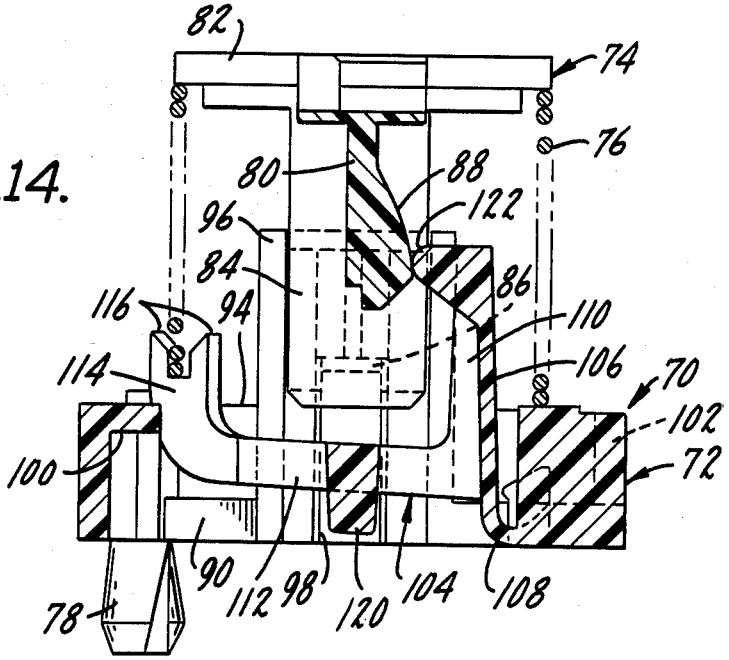
FIG. 14 is a section, similar to FIG. 2, illustrating an alternate embodiment of the invention, i.e., a linear switch.

The present invention relates to a keyboard switch in which the point of closure or "make point" is dependent on the geometry of the switch parts and not on the force applied to the switch. In other words, the switch will close only after the plunger has moved inwardly a given distance. Only upon such movement will the switch parts assume positions wherein the geometry of the parts allows application of a closing force to the membrane switch. The application of the closing force may be gradual or sudden. In the former case, the force applied to the membrane switch is a smooth, continuous function of the plunger travel; there are no sudden changes in the force. Since the force-deflection curve is generally a straight line, this switch is called a linear switch. In the latter case, an effectively instantaneous jump in the force-deflection curve is deliberately created so the user can feel it and know when the switch has closed. This is called a tactile switch. In both the linear and tactile switches the actuator lever is restrained from applying a switch closing force until the plunger has moved inwardly a given distance.

The tactile switch of the present invention finds utility in keyboards, such as computer terminals, typewriters, calculators and other applications in which it is desirable that the key have a very low profile. For example, the total height of the entire key structure disclosed herein normally will not be greater than one-half inch. With a key construction of this dimension, the travel of the key actuator from the unoperated to the operated position will normally be quite small. In the present instance such travel may be on the order of slightly more than one-eighth inch. Heretofore, it has been a problem in keyboards of this size for the operator of the key to feel confident that in fact the key has been pressed in a manner as to insure a switch closure in the underlying membrane switch array. Thus, it is necessary for there to be a tactile feel in operation of the key or some indication to the user that in fact the key has been pressed to the degree necessary to cause operation of the switch. In one aspect the present invention is specifically directed to such a tactile key and to a means for providing a tactile feel in key operation. The tactile feel must not be a gradual sensation, but, rather, there must be an abrupt or sudden movement in operation of the key so that the operator is assured and in fact completely confident that switch operation has taken place.

Considering first FIGS. 1, 2 and 3, the tactile switch includes a housing indicated generally at 10 having a central opening 12 mounting a reciprocal plunger 14. The plunger may mount a keycap 16 of a conventional size and shape for keyboard operation. Pivotally mounted on the housing and in position to be in cooperative contact with plunger 14 is a lever 18 which will be described in more detail hereinafter.

Housing 12 is seated upon a membrane switch array which may consist of the conventional lower substrate 20, intermediate spacer 22 and membrane 24. Conventionally, the membrane and substrate will have electrical contacts thereon which normally will be positioned beneath plunger 14. There will be the usual opening 26 in the spacer beneath the switch so that movement of keycap 16 and thus plunger 14 can effect a switch closure between the membrane and substrate.

Housing 10 has a cylindrical wall 28 which defines opening 12 and that portion of housing 10 beneath opening 12 may have arcuate slots 30 just inside of wall 28, with slots 30 cooperating with arcuate projections 32 on the bottom of the plunger to maintain alignment and relative position between these two elements during switch operation. The bottom of the housing may have an opening 31 which will permit lever 18 to effect a switch closure. Further, in order to maintain the plunger within opening 12, housing 10 has oppositely-disposed hook elements 34, illustrated in FIG. 6, which will ride in cooperating grooves 36 on the sides of the plunger. Note that grooves 36 have a lower surface 38 forming a stop which prevents removal of the plunger from the housing opening. When the plunger is initially inserted during assembly, the plunger will be pushed past hooks 34 which will flex to permit assembly. Once assembled, the plunger cannot be removed from the housing.

Lever 18 has a pivot portion 40 which is positioned within a slot 42 of housing portion 44 formed at one corner of the housing. Lever 18 is accordingly mounted for pivotal movement between the FIG. 2 and 3 positions. Lever 18 has a spring support portion 46 which extends through an opening in wall 28 of the housing and provides a spring seat 48 which will seat a coil spring 50 which is captured between the spring seat and an inner surface 52 of plunger 14. In addition, spring seat portion 46 of lever 18 includes a downward projecting boss 54 which is positioned, as specifically illustrated in FIG. 3, to provide a closure of the underlying membrane switch by forcing a portion of membrane 24 through opening 26 in the spacer so that there is contact between the electrical conductive areas of the membrane and substrate.

The side of plunger 14 which faces lever 18 has a reset ramp 56 and a threshold ramp 58 with the reset ramp and threshold being separated by an open area or slot 60. To cooperate with the cam areas on plunger 14, lever 18 has a nose 62 which is positioned in alignment with reset ramp 56 and an arm 64 which cooperates with threshold 58 to hold the lever in the non-actuated position of FIGS. 2 and 4 until such time as arm 64 is in alignment with threshold 58. Lever 18 further has a stop 66 positioned directly behind arm 64 which restricts movement of the arm to a single plane.

The unoperated position of the switch is illustrated in FIG. 2. Coil spring 50 is seated upon that portion 48 of lever 18 which extends into opening 12 and the spring maintains plunger 14 and keycap 16 in the up or unoperated position. As the keycap, and hence the plunger, are depressed during switch operation, spring 50 will be compressed as the keycap moves toward the underlying membrane switch array. However, as illustrated in FIG. 4, lever 18 will be maintained in the FIG. 2 position because its arm 64 will bear against the face of threshold 58. Only when plunger 14 has been depressed a sufficient distance for arm 64 to clear threshold 58 can there be inward movement of the lever. Once the arm has cleared the threshold, the lever will suddenly move to the position of FIG. 3 to effect a switch closure. The force which will drive the lever through such movement is that provided by spring 50. The spring is compressed as the keycap is moved inward. Once the lever is permitted to move to the switch closure position of FIG. 3, the compressed spring will provide the necessary force to effect such sudden movement.

During reset or outward movement of the keycap nose 62 of lever 18 will bear against reset ramp 56. The cooperation between these two surfaces will cause the lever to pivot in a clockwise direction as the force of spring 50 moves the keycap back to the position of FIG. 2. Arm 64, as it is bearing against threshold 58, will to some degree retard the outward movement of the keycap, but the arm will flex in the single plane of its movement, as indicated in broken lines in FIG. 5, as the plunger and keycap retract. Stop 66 will prevent the arm from moving in any direction other than in the vertical plane parallel with threshold 58. Thus, the arm is protected by stop 66 and is permitted the flexing movement required so that the keycap and plunger can retract. Movement of the lever during the retraction of the plunger is controlled by nose 62 riding upon reset ramp 56.

Of particular importance in this aspect of the invention is the provision of a tactile feel driving switch closure. The sudden movement can be felt by the operator of the key, thereby giving the required tactile sensation to tell the operator that in fact the key has been moved to a switch closure position. The switch closure force is effected by the compression of the return spring during the downward movement of the key. The spring is compressed until such time as the plunger has moved inwardly a distance to permit the sudden movement required for a switch closure and this sudden movement is effected by the stored force in spring 50.

We show the compound movement of the rocker member by pivotal movement in one plane and by flexing in another plane. The same type of compound movement can be derived by having the rocker mounted on a universal pivot or ball so that it can pivot in two planes.

Figure 15:
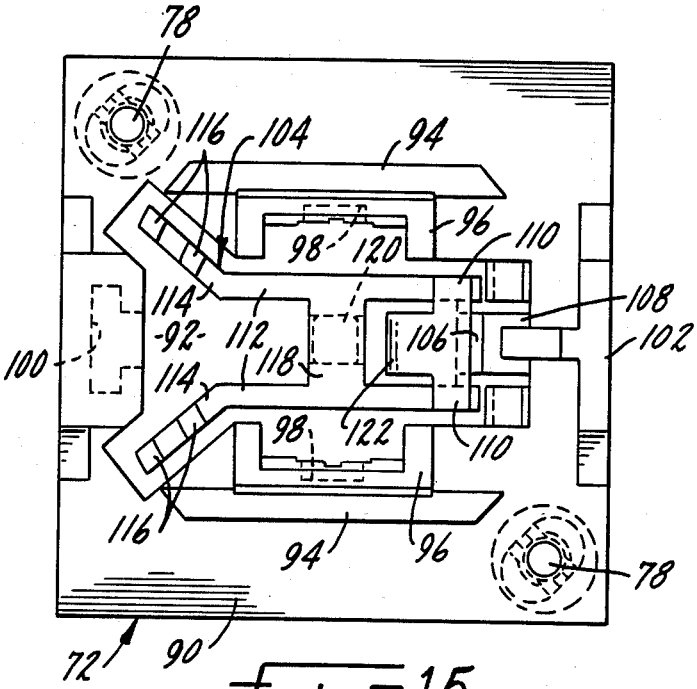
FIG. 15 is a plan view of the housing for the linear switch of FIG. 14.
Figure 16:
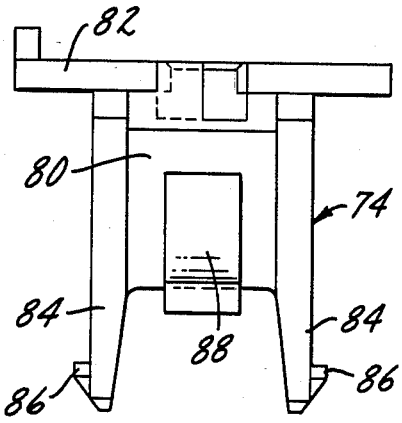
FIG. 16 is a side elevation view of the plunger for the linear switch of FIG. 14.

FIGS. 14–16 illustrate an alternate embodiment of the invention. This is the linear switch referred to above. Linear switch 70 has three main parts; a housing 72, a plunger 74 and a spring 76. It will be understood that the switch is designed for use with a membrane switch array mounted on a base plate, although the membrane switch array and base plate are not shown. The switch is attached to the base plate by a pair of expandable rivets 78.

The plunger 74 includes a body portion 80 to which a cap 82 is connected. The cap engages the spring 76 as shown in FIG. 14. An appropriate key top (not shown) would be attached to the cap 82. A pair of integrally formed legs 84 extend from either side of the body 80. The legs 84 carry hooks 86 near their ends. A cam surface 88 is formed on one side of the body 80. As shown in FIG. 14, the cam surface has a gradual, sloped configuration.

The housing 72 includes a generally flat base 90 having a central opening 92 therein. A pair of upstanding walls are located in facing relation on either side of the opening 92. Each wall includes an elongated lower portion 94 and a U-shaped upper portion 96 which extends above the lower portion 94. The bight of the U-shaped wall includes a groove or channel 98 in which the hooks 86 of the plunger ride. The groove 98 extends about halfway up the wall portion 96. Its terminus forms an up stop for the plunger. The lower portions 94 of the walls provide a base on which the spring 76 bottoms.

Other features of the housing include a chamber 100 in which an optional cam follower may be inserted to provide an alternate action-type switch. The housing also has an upstanding spring support wall 102. Along with the wall portions 94, the spring support 102 provides a base on which the spring 76 rests.

An actuator lever is shown generally at 104. The lever is disposed above the housing opening 92 and between the walls 94,96. The actuator lever 104 includes an elongated, upright bracket 106. The bracket is pivotally attached to the base of the housing by a flexible hinge 108, commonly referred to as a living hinge. A pair of extension pieces 110 are connected to the top of the bracket and extend downwardly therefrom. The extensions merge into a pair of legs 112 which extend generally horizontally across the bottom of the housing. The legs 112 extend beyond the wall portions 96 and terminate with a pair of upturned feet 114. Each foot 114 has two tabs 116 which form a slot between them for retaining the spring 76, as best seen in FIG. 14. The legs 112 are connected by a strap 118. On the underside of the strap there is a knob 120 which is the part that actually contacts the membrane switch.

A cam surface 122 is formed at the upper end of the bracket 106. This surface is in the nature of a cam follower as it engages the cam surface 88 on the plunger 74.

The operation of the linear switch is as follows. The plunger body 80 and legs 84 are disposed in the housing between the U-shaped walls 96. The hooks 86 slide in the grooves 98 and are retained therein. The spring 76 is compressed between the plunger cap 82 and the lower wall portions 94, the spring support 102 and the feet 114 of the actuator lever 104. Thus, the spring urges the lever toward the membrane switch, i.e., in a counterclockwise direction (as seen in FIG. 14) about the hinge 108. When the switch is in the unoperated, rest position (as in FIG. 14) the lever is restrained from moving into a membrane switch closing position by the engagement of the cam follower 122 on the cam surface 88. When a user pushes the plunger inwardly, the cam surface 88 allows the lever 104 to pivot about the hinge 108 and bring the knob 120 into contact with the membrane switch. The compressed spring acts on the lever to gradually apply a membrane switch closing force through the knob 120. As can be seen in FIG. 14, the cam surface 88 has a sloped configuration. This permits the gradual application of switch closing force in a smooth and continuous manner. When the user releases the plunger the spring 76 causes the plunger to move outwardly in the housing while at the same time the cam surface 88 resets the actuator lever 104 to its rest or non-operative position. It can be seen that the cam surface 88 prevents the lever from moving to a switch closing position until the plunger has moved inwardly a given distance. That distance can be regulated by the shape of the cam surface.

It will be understood that the cam surface 88 does not have to have a smooth and continuous configuration. It could also have a sharp step or drop-off which would prevent any movement of the lever until the last possible moment. Then the lever would be released suddenly with the switch closing force being applied effectively instantaneously. This would provide a tactile feel as in the switch of FIGS. 1–13.

Whereas the preferred form of the invention has been shown and described herein, it should be realized that there may be many modifications, substitutions and alterations thereto.

The embodiments of the invention in which an exclusive property or privilege is claimed are defined as follows:

1. A low profile keyboard switch having tactile feel for use in combination with a membrane switch array, including a housing adapted to be positioned on a membrane switch array, an upright opening in said housing, a plunger reciprocal in said housing, an actuator lever pivotally mounted on said housing and positioned for engagement by said plunger, spring means seated upon said lever and urging said plunger outwardly in said opening, cooperating cam surfaces on said plunger and lever preventing movement of said lever to a membrane switch closing position until said plunger has moved inwardly a given distance, inward movement of said plunger compressing said spring means with movement of said plunger beyond the given distance causing the sudden application of a switch closing force, from said compressed spring means, by said lever on the underlying switch array.

2. The switch of claim 1 further characterized in that said lever has a portion aligned with said plunger and extending into said opening, said spring means being positioned between said lever portion and said plunger.

3. The switch of claim 2 further characterized in that said cooperating cam surfaces includes an arm on said lever and a threshold on said plunger, said threshold holding said lever in a non-membrane switch operative position until the plunger has moved inwardly the distance to permit said arm to pass said threshold, whereby said lever will suddenly move, in response to force from said spring means, to a switch closing position.

4. The switch of claim 3 further characterized in that said cooperating cam means includes a reset ramp, with a portion of said lever being in engagement with said reset ramp when said plunger moves outwardly of said opening to return to a non-actuated position.

5. The switch of claim 1 further characterized in that said lever includes an inner projecting surface located directly above a membrane switch array to cause actuation thereof.

6. The switch of claim 1 further characterized in that said spring means is a coil spring extending within said plunger, said lever having a portion extending into said opening, underlying said plunger and seating said coil spring, inward movement of said plunger compressing said spring whereby inward movement of said plunger through the given distance causing the sudden pivotal movement of said lever, with said spring applying a switch closing force thereto.

7. The switch of claim 6 further characterized by and including an arm on said lever in contact with a threshold portion of said plunger, inward movement of said plunger through the given distance permitting said arm to move past said threshold, thereby permitting pivotal movement of said lever to a switch closing position.

8. A keyboard switch for use in combination with a membrane switch array, including a housing adapted to be positioned on a membrane switch array, an upright opening in said housing, a plunger reciprocal in said housing, an actuator lever pivotally mounted on said housing and positioned for engagement by said plunger, spring means seated upon said lever and urging said plunger outwardly in said opening, cooperating cam surfaces on said plunger and lever preventing movement of said lever to a membrane switch closing position until said plunger has moved inwardly a given distance, inward movement of said plunger compressing said spring means with movement of said plunger beyond the given distance allowing the application of a switch closing force, from said compressed spring means, by said lever on the underlying switch array.

9. The switch of claim 8 wherein the cam surfaces have a sloped configuration such that the lever gradually applies a switch closing force on the membrane switch array.

10. The switch of claim 8 wherein the cam surfaces have a discontinuous configuration such that the lever initially is restrained in a non-operative position and then is released to apply a sudden switch closing force and provide a tactile feedback.

11. The switch of claim 8 wherein the actuator lever is connected to the housing by an integral hinge.

* * * * *